US005324085A

United States Patent [19]

Hintz, Jr.

[11] Patent Number: 5,324,085

[45] Date of Patent: Jun. 28, 1994

[54] CONCRETE SCREED HANDLE ASSEMBLY

[76] Inventor: Harry W. Hintz, Jr., R.D. #1 Box 132, Muncy, Pa. 17756

[21] Appl. No.: 27,449

[22] Filed: Mar. 8, 1993

[51] Int. Cl.[5] ..... E01C 19/44

[52] U.S. Cl. ..... 294/16; 404/118; 16/114 R; 15/235.4

[58] Field of Search ..... 294/15, 16, 170, 171; 15/235.4, 235.5, 235.6, 235.7, 235.8, 245.1; 404/118, 119, 120, 97; 16/114 R

[56] References Cited

U.S. PATENT DOCUMENTS

| | | | |
|---|---|---|---|
| 1,406,811 | 2/1922 | Bachrik | 294/170 X |
| 3,046,856 | 7/1962 | Baxter | 404/118 |
| 4,023,702 | 5/1977 | McKnight | 16/114 R X |
| 4,256,416 | 3/1981 | Bishop | 404/119 |
| 4,417,361 | 11/1983 | Smith | 294/16 X |
| 4,449,845 | 5/1984 | Carrillo | 404/118 |
| 4,828,427 | 5/1989 | Nisenbaum | 404/97 |
| 5,016,319 | 5/1991 | Stigen | 404/119 X |

FOREIGN PATENT DOCUMENTS

| | | | |
|---|---|---|---|
| 1934158 | 2/1980 | Fed. Rep. of Germany | 404/118 |
| 2234000 | 1/1991 | United Kingdom | 404/118 |

*Primary Examiner*—Dean J. Kramer

[57] ABSTRACT

The invention is a Concrete Screed Handle assembly which provides a comfortable and stable grasping mechanism for an individual who wishes to put a screed board into a side-to-side motion while advancing it over a wet concrete surface. It is of tubular construction, inverted U-shaped while being used, and has two clamping points roughly shoulder width apart which mount onto the top of the screed board. The clamps on the handle assembly are hand-tightened through threaded bolt/stop assembly which, through a pivoting lever action, clamps the screed board to the handle assembly.

2 Claims, 1 Drawing Sheet

CONCRETE SCREED HANDLE ASSEMBLY

BACKGROUND OF THE INVENTION

This handle was developed to reduce the difficulty of the side-to-side motion and advancement of the concrete screed over a freshly poured concrete ribbon or pad, while providing the concrete screed handle assembly at an affordable price.

As would be known by a person familiar with the art, the screeding operation is very tiresome and awkward. The screed board operator(s) either bend forward at the waist or assume a crouching position beside the screed board. They then grasp the board (usually a 2×4 or 2×6 common on a construction site) with both hands, thumbs on one side and fingers on the other, variably moving their arms side-to-side while pulling the screed board toward them over the wet concrete surface. This motion is necessary to settle the aggregate and level the surface under the screed board to a pre-established grade height. The board must pass in this manner over the entire surface of the pour. A well-designed handle providing rigid clamping and comfortable grasping would make the operation much less tiring and quicker.

The screed board operators frequently find it necessary to remove high spots and fill voids in the wet concrete surface immediately in the path of the screed board. To do this, they need to be at the concrete surface level, usually making the corrections with a trowel. For this reason, a taller handle assembly such as the one described in U.S. Pat. No. 4,828,427 issued to Nisenbaum, though it does make the screeding process less tiresome because of operating the screed board from a standing position, limits the flexibility of the operator as the handle must remain upright during the screeding process. In my opinion, this necessary upright position would make concrete surface corrections difficult.

The handle-screed board assembly in U.S. Pat. No. 4,256,416 issued to Bishop is effective in diminishing the tiresome effects of screeding, however, my handle assembly as a unit is more rigid with reference to the side-to-side motion of the screed board because of two separate clamping points along the screed board on each handle assembly.

In addition, this handle installs with less physical effort and is more adaptable to periodic adjustment than the previously mentioned handle by Bishop because of the self-contained screw-type clamping mechanism on the handle to screed board clamp points.

The grasping points on the handle are comfortably sized and spaced. The handle may be used from either a crouching or bent-at-the-waist position. The preceding features make this concrete screed handle assembly superior over any currently on the market or patented in the past.

SUMMARY OF THE INVENTION

Having noted disadvantages of previously issued patents, the advantages inherent in my handle assembly will be expanded upon, and the basic handle structure more thoroughly described.

My handle assembly is economical to produce making it likewise easily obtainable by the general public. The handle assembly is easily stored and reusable from one job to the next. The screed handle assembly mounts quickly and easily to the screed board through the use of a threaded, hand-tightened clamping assembly. The handle assembly is easily adjustable with reference to:

1. re-tightening if during use it becomes loose or
2. it becomes necessary to move the handle assembly to a different location on the screed board for convenience sake.

The leverage increasing effects put upon the screed board through use of this handle assembly enables the screed board operator to concentrate his/her efforts on the accuracy of the screed board path versus concentrating one's efforts on the strenuous action of screed board movements as described under "Background of the Invention."

DESCRIPTION OF THE PREFERRED EMBODIMENTS

Figure 4:
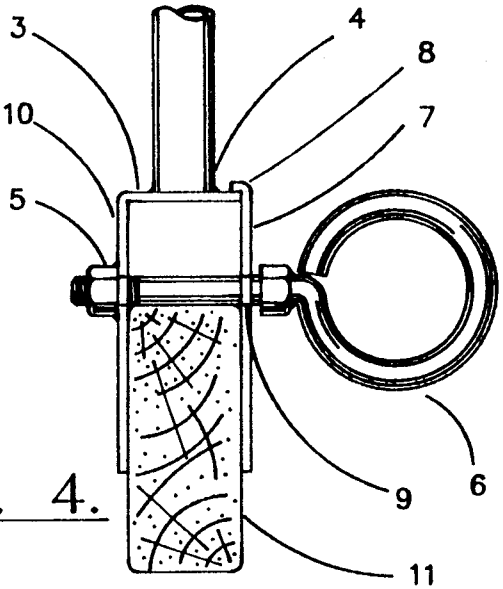
FIG. 4 is an enlarged view of the clamping assembly.
Figure 3:
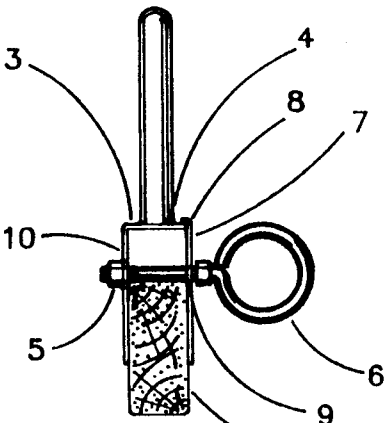
FIG. 3 is a right side view.
Figure 1:
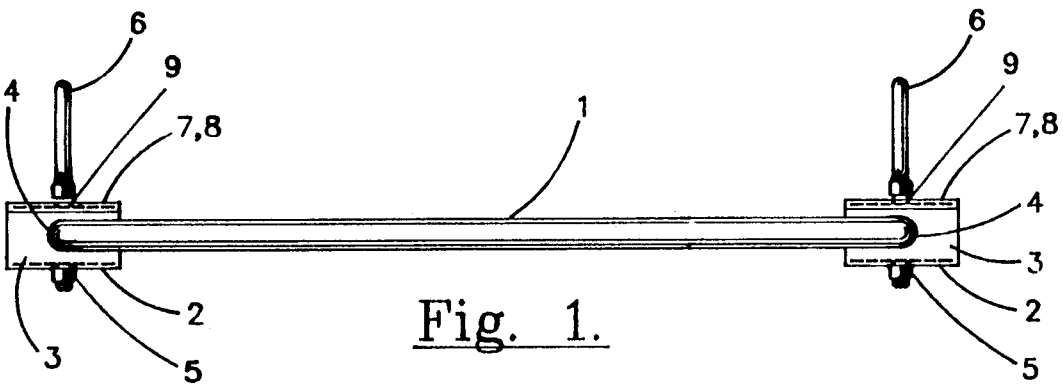
FIG. 1 is a top view of the screed handle assembly.
Figure 2:
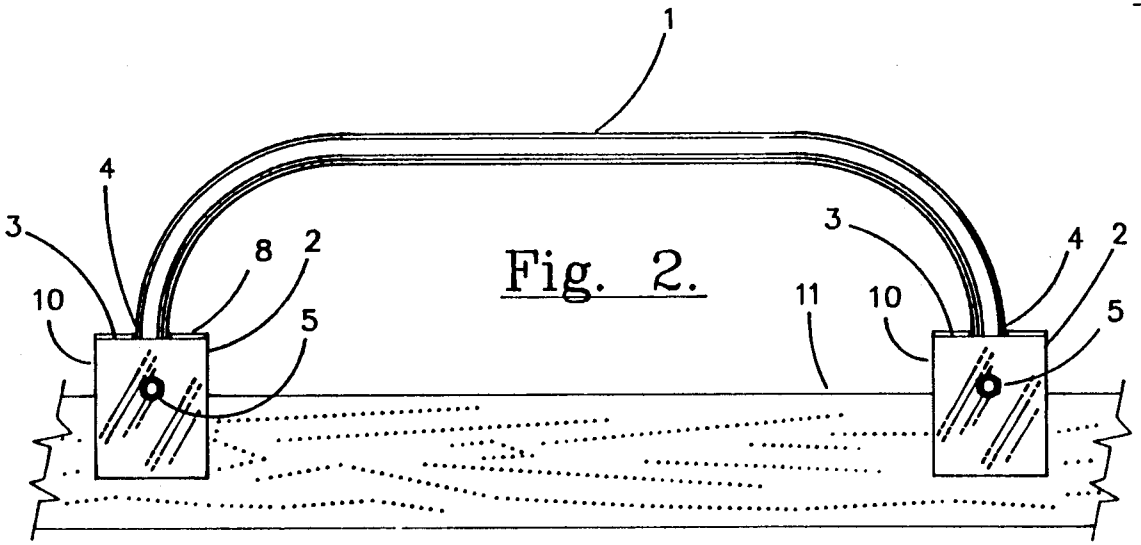
FIG. 2 is a front view.

My screed handle assembly is an inverted "U" shaped tubular structure FIG. 2 with releasable screw-type pressure clamps on both ends of the "U" FIG. 2—2. Each clamp comprises a fixed L-shaped angle FIG. 3—3 welded by the short leg 3 onto the open ends of the vertical tubes 4, open end of the angle away from the vertical tube 4 and parallel with the horizontal handle position FIG. 2—1. On each long leg of this angle FIG. 3—10 a threaded thru-extending aperture 5 is mounted so that an opposing moveable plate 7 with matching thru-extending aperture 9 and longitudinal crease 8 along its top edge for alignment stability may be pressed against the top edge of the screed board through use of a rotating connecting bolt/stop assembly 6. The opposing moveable plate 7 and L-shaped metal angle 10 also have small protrusions on their surfaces which contact the screed board 11 to improve their friction coefficients. During use, the hands are normally placed on the curved portions of the handle assembly but may be placed anywhere on the handle as the operator chooses.

Alterations could be made on the clamping assembly and handle configuration, but it would not depart from the intent of my handle assembly. The claims should include such similar assemblies as long as they do not depart from this intent.

Having completed the Background, Summary, and Description of Drawings of my invention I wish to state the claims and protect by letter patent:

I claim:

1. A concrete working device for attachment to a screed board comprising in combination:

a U-shaped screed handle;

a screed board releasably attached to said U-shaped screed handle by a pressure plate clamping assembly;

said pressure plate clamping assembly is comprised of a fixed L-shaped angle member attached to said U-shaped screed handle and opposing moveable plate, said fixed L-shaped angle member and said opposing moveable plate in clamping relationship to said screed board;

a longitudinal crease on end portion of said opposing moveable plate, said longitudinal crease in aligning relationship with, and wholly pivoting upon the end portion of said L-shaped angle member;

a bolt/stop assembly extending through said opposing moveable plate and attached through thread means to said fixed L-shaped angle member;

a clamping nut attached to said bolt/stop assembly and in clamping contact with said opposing moveable plate;

said U-shaped screed handle is integrally attached to said fixed L-shaped angle member, said U-shaped screed handle positioned parallel to said screed board.

2. The combination as claimed in claim 1 in which the end portions of said U-shaped screed handle are each attached to said pressure plate clamping assembly, attached to said screed board.

* * * * *